US010465685B2

(12) United States Patent
Huang et al.

(10) Patent No.: US 10,465,685 B2
(45) Date of Patent: Nov. 5, 2019

(54) AIR CONDITIONER WITH STACKED PARALLEL AND SERIAL COMPRESSOR CYLINDERS

(71) Applicant: Green Refrigeration Equipment Engineering Research Center of ZHUHAI GREE CO., Ltd., Zhuhai, Guangdong (CN)

(72) Inventors: Hui Huang, Zhuhai (CN); Yusheng Hu, Zhuhai (CN); Huijun Wei, Zhuhai (CN); Liping Ren, Zhuhai (CN); Jia Xu, Zhuhai (CN); Jian Wu, Zhuhai (CN); Ouxiang Yang, Zhuhai (CN); Shebing Liang, Zhuhai (CN); Huifang Luo, Zhuhai (CN); Hongwei Zhu, Zhuhai (CN)

(73) Assignee: GREEN REFRIGERATION EQUIPMENT ENGINEERING RESEARCH CENTER OF ZHUHAI GREE CO., LTD., Zhuhai, Guangdong (CN)

( * ) Notice: Subject to any disclaimer, the term of this patent is extended or adjusted under 35 U.S.C. 154(b) by 0 days.

(21) Appl. No.: 15/303,096

(22) PCT Filed: Apr. 30, 2015

(86) PCT No.: PCT/CN2015/078115

§ 371 (c)(1),
(2) Date: Oct. 10, 2016

(87) PCT Pub. No.: WO2015/154726

PCT Pub. Date: Oct. 15, 2015

(65) Prior Publication Data

US 2017/0030355 A1 Feb. 2, 2017

(30) Foreign Application Priority Data

Apr. 10, 2014 (CN) ..... 2014 1 0144072

(51) Int. Cl.
*F04C 23/00* (2006.01)
*F04C 18/356* (2006.01)

(52) U.S. Cl.
CPC ..... *F04C 23/00* (2013.01); *F04C 18/356* (2013.01); *F04C 23/003* (2013.01)

(58) Field of Classification Search
CPC ..... F04C 23/00; F04C 23/003; F04C 28/18
(Continued)

(56) References Cited

U.S. PATENT DOCUMENTS 2,957,426 A * 10/1960 Miller ..... F04D 1/10 415/145
5,871,342 A 2/1999 Harte et al.
(Continued)

FOREIGN PATENT DOCUMENTS

CN 1950611 A 4/2007
CN 103953545 A 7/2014
(Continued)

OTHER PUBLICATIONS

State Intellectual Property Office of the People's Republic of China, Written Opinion of the International Searchc Authority dated Aug. 5, 2015.

*Primary Examiner* — Mary Davis
(74) *Attorney, Agent, or Firm* — Li & Cai Intellectual Property (USA) Office

(57) ABSTRACT

The invention discloses a compressor. The compressor includes a first primary cylinder, a second primary cylinder and a secondary cylinder, which are stacked, a separator is provided between two adjacent cylinders. The first primary cylinder is provided with a first air entry, the second primary cylinder is provided with a second air entry, and the secondary cylinder is provided with an air outlet. The first primary cylinder and the second primary cylinder are connected in serial to the secondary cylinder after being connected in parallel. A refrigerant entering the first air entry and the second air entry is discharged from the air outlet after primary or/and secondary compression. The two sepa-
(Continued)

rators are divided into a first separator and a second separator. Any one or two of the first separator, the second separator and a lower flange may be provided with a slide piece control device.

16 Claims, 18 Drawing Sheets

(58) Field of Classification Search
USPC ..... 418/15, 23, 24, 25, 27
See application file for complete search history.

(56) References Cited

U.S. PATENT DOCUMENTS

| | | | | |
|---|---|---|---|---|
| 8,225,624 | B2 * | 7/2012 | Yamaguchi | F04C 23/001 62/175 |
| 9,353,743 | B2 * | 5/2016 | Ehrhardt | F04C 11/005 |
| 2011/0070115 | A1 * | 3/2011 | Takahashi | F04C 23/006 418/5 |
| 2014/0094727 | A1 * | 4/2014 | Deshpande | A61H 9/005 601/152 |
| 2017/0022988 | A1 * | 1/2017 | Huang | F04C 23/00 |
| 2017/0038099 | A1 * | 2/2017 | Liang | F25B 1/10 |

FOREIGN PATENT DOCUMENTS

| | | | | | |
|---|---|---|---|---|---|
| CN | 203809296 | U | | 9/2014 | |
| JP | 5612085 | A | | 2/1981 | |
| JP | 5190792 | A | | 1/1984 | |
| JP | 59010792 | A | * | 1/1984 | F04C 28/06 |
| JP | 05106576 | A | * | 4/1993 | F04C 23/008 |
| JP | 5106576 | A | | 4/1993 | |

* cited by examiner

AIR CONDITIONER WITH STACKED PARALLEL AND SERIAL COMPRESSOR CYLINDERS

TECHNICAL FIELD OF THE INVENTION

The invention relates to the field of refrigeration, and in particular to a multi-cylinder double-stage enthalpy-enhanced and volume-variable compressor and an air conditioner.

BACKGROUND OF THE INVENTION

A rolling rotor type double-stage compressor is a double-cylinder double-stage enthalpy-enhanced compressor, generally. Due to limitation of displacement of the compressor, electric auxiliary heating needs to be adopted under low-temperature working conditions to improve the heating capacity of the compressor. If the displacement of the compressor needs to be increased, it is necessary to increase compressor series, thus increasing the size of the compressor, and improving the cost. In addition, the double-cylinder double-stage enthalpy-enhanced compressor cannot operate with high volume ratio under refrigeration working conditions and operate with large displacement and low volume ratio under refrigeration working conditions.

SUMMARY OF THE INVENTION

In view of the situation in the prior art, the invention is intended to provide a compressor and an air conditioner. The compressor may operate in multiple modes, and different modes may be selected according to different application occasions, thus improving the heating capability, and improving the capabilities of a rated point and an intermediate point. To this end, the technical solutions of the invention are as follows.

A compressor comprises a first primary cylinder, a second primary cylinder, a secondary cylinder and a lower flange, wherein the first primary cylinder, the second primary cylinder and the secondary cylinder are stacked, a separator is provided between two adjacent cylinders, the secondary cylinder is provided at the same side of the first primary cylinder and the second primary cylinder, or the secondary cylinder is provided between the first primary cylinder and the second primary cylinder, and the lower flange is provided at the lower sides of the first primary cylinder, the second primary cylinder and the secondary cylinder;

the first primary cylinder is provided with a first air entry and a first slide piece groove, a first slide piece is provided in the first slide piece groove, the second primary cylinder is provided with a second air entry and a second slide piece groove, a second slide piece is provided in the second slide piece groove, the secondary cylinder is provided with an air outlet and a third slide piece groove, and a third slide piece is provided in the third slide piece groove; the first primary cylinder and the second primary cylinder are connected in parallel, the first primary cylinder and the second primary cylinder are connected in serial to the secondary cylinder after being connected in parallel, and a refrigerant entering the first air entry and the second air entry is discharged from the air outlet after primary or/and secondary compression; and two separators are divided into a first separator and a second separator, and any one or two of the first separator, the second separator and a lower flange are provided with a slide piece control device configured to control a slide piece to act, the slide piece control device corresponding to the slide piece.

Preferably, the first primary cylinder and the second primary cylinder are provided at a lower side of the secondary cylinder separately, the first separator or/and the second separator is/are provided with the slide piece control device, and the first primary cylinder or/and the second primary cylinder serve(s) as an unloadable cylinder(s).

Preferably, the first primary cylinder and the second primary cylinder are provided at a lower side of the secondary cylinder separately, the lower flange is provided with the slide piece control device, and a lower one of the first primary cylinder and the second primary cylinder serves as an unloadable cylinder.

Furthermore, the first separator or the second separator is provided with the slide piece control device, an upper one of the first primary cylinder and the second primary cylinder serves as an unloadable cylinder, or the secondary cylinder serves as an unloadable cylinder.

Preferably, the secondary cylinder is provided between the first primary cylinder and the second primary cylinder, the first separator or/and the second separator are provided with the slide piece control device, the first primary cylinder or/and the secondary cylinder serve(s) as an unloadable cylinder(s), or the second primary cylinder or/and the secondary cylinder serve(s) as an unloadable cylinder(s).

Preferably, the secondary cylinder is provided between the first primary cylinder and the second primary cylinder, the lower flange is provided with the slide piece control device, and a lower one of the first primary cylinder and the second primary cylinder serves as an unloadable cylinder.

Preferably, the first separator or the second separator is provided with the slide piece control device, an upper one of the first primary cylinder and the second primary cylinder serves as an unloadable cylinder, or the secondary cylinder serves as an unloadable cylinder.

Preferably, the first primary cylinder and the second primary cylinder are provided at an upper side of the secondary cylinder separately, the first separator or/and the second separator are provided with the slide piece control device, and the first primary cylinder or/and the second primary cylinder serve(s) as an unloadable cylinder(s).

Preferably, the first primary cylinder and the second primary cylinder are provided at an upper side of the secondary cylinder separately, the lower flange is provided with the slide piece control device, and the secondary cylinder serves as an unloadable cylinder.

Furthermore, the first separator or the second separator is provided with the slide piece control device, and the first primary cylinder or the second primary cylinder serves as an unloadable cylinder.

Preferably, the slide piece control device comprises a pin and an elastic reset element, the elastic reset element is provided at a tail of the pin, any one or two of the first slide piece, the second slide piece and the third slide piece are provided with a locking groove, the pin is configured to match with the locking groove, when the pin is provided in the locking groove, the slide piece is locked, and after the pin is disengaged from the locking groove, the slide piece is unlocked.

Furthermore, the first separator or/and the second separator are provided with a through hole corresponding to the locking groove; or, the first separator or/and the lower flange is/are provided with a through hole corresponding to the locking groove; or, the second separator or/and the lower flange is/are provided with a through hole corresponding to the locking groove; and the pin is provided in the through hole, the pin is in seal fit with the through hole, and the pin can move in an axial direction of the through hole.

Preferably, a ratio of a secondary volume to a primary volume of the compressor under a double-stage compression mode is 0.3-0.6 or 0.8-1.3.

Preferably, the lower flange is provided with an intermediate cavity.

The invention also relates to an air conditioner, which comprises a compressor, the compressor is the compressor in any one of the technical solutions.

The invention has the beneficial effects as follows.

In the compressor and air conditioner of the invention, the compressor may operate in multiple modes, and different modes are selected according to different application occasions, thus improving the heating capability, and improving the capabilities of a rated point and an intermediate point. The structural limitation is avoided, and the displacement is increased, thus reducing the size of the compressor, and lowering the cost. Two primary cylinders may not be limited by series, so as to achieve large-displacement compression. The volumes may be variable by changing working and unloading states of the cylinders, and requirements for energy efficiency and capabilities under different compressor working conditions are met. For example, the heating capacity under a low-temperature heating situation may be greatly increased by means of three-cylinder double-stage enthalpy-enhanced operation, the energy efficiency of the intermediate point may be improved by means of single-cylinder operation, and the energy efficiency of the rated point may be improved and guaranteed by means of double-cylinder double-stage enthalpy-enhanced operation or double-cylinder operation.

DETAILED DESCRIPTION OF THE EMBODIMENTS

Figure 1:
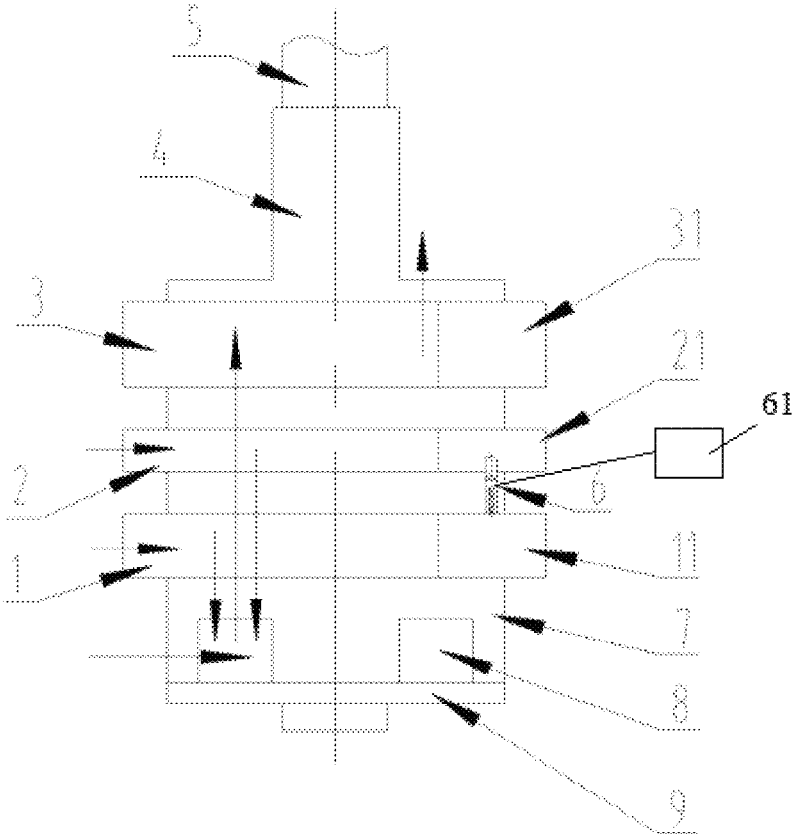
FIG. 1-6 are structural diagrams of a compressor having a volume-variable cylinder according to the invention.

To make the purposes, technical solutions and advantages of the invention clearer, a compressor and air conditioner of the invention will be further illustrated with a three-cylinder rotor compressor in conjunction with the drawings and embodiments in detail. It should be understood that specific embodiments described herein are only intended to explain the invention without limiting the invention.

Referring to FIG. 1 to FIG. 18, an embodiment for a compressor of the invention comprises a first primary cylinder 1, a second primary cylinder 2, a secondary cylinder 3, a lower flange 7, an upper flange 4 and a crankshaft 5, wherein the first primary cylinder 1, the second primary cylinder 2 and the secondary cylinder 3 are stacked, a separator is provided between two adjacent cylinders, the secondary cylinder 3 is provided at the same side of the first primary cylinder 1 and the second primary cylinder 2, or the secondary cylinder 3 is provided between the first primary cylinder 1 and the second primary cylinder 2, the lower flange 7 is provided at the lower sides of the first primary cylinder 1, the second primary cylinder 2 and the secondary cylinder 3, the lower flange 7 is provided with an intermediate cavity 8, and a lower cover plate 9 is provided at a lower end of the lower flange 7.

Wherein FIGS. 1-18 are taken thru slide grooves, the first primary cylinder 1 is provided with a first air entry and a first slide piece groove (shown), a first slide piece 11 is provided in the first slide piece groove, the second primary cylinder 2 is provided with a second air entry and a second slide piece groove (shown), a second slide piece 21 is provided in the second slide piece groove, the secondary cylinder 3 is provided with an air outlet and a third slide piece groove (shown), and a third slide piece 31 is provided in the third slide piece groove; and the first primary cylinder 1 and the second primary cylinder 2 are connected in parallel, the first primary cylinder 1 and the second primary cylinder 2 are connected in serial to the secondary cylinder 3 after being connected in parallel, and a refrigerant entering the first air entry and the second air entry is discharged from the air outlet after primary or/and secondary compression.

The two separators are divided into a first separator and a second separator, and any one or two of the first separator, the second separator and a lower flange 7 may be provided with a slide piece control device configured to control a slide piece to act, the slide piece control device 6 corresponding to the slide piece.

As an implementable mode, the slide piece control device 6 comprises a pin, an elastic reset element and a control member 61 connected with the pin, the control member 61 is used to disengage the pin, the elastic reset element is provided at a tail of the pin, any one or two of the first slide piece 11, the second slide piece 21 and the third slide piece 31 is provided with a locking groove, the pin is configured to match with the locking groove, when the pin is provided in the locking groove, the slide piece is locked, and after the pin is disengaged from the locking groove, the slide piece is unlocked. The elastic reset element may be a spring.

The first separator or/and the second separator is/are provided with a through hole corresponding to the locking groove; or, the first separator or/and the lower flange is/are provided with a through hole corresponding to the locking groove; or, the second separator or/and the lower flange is/are provided with a through hole corresponding to the locking groove; and the pin is provided in the through hole, the pin is in seal fit with the through hole, and the pin can move in an axial direction of the through hole.

Embodiment 1

A situation where one of primary cylinders of a three-cylinder double-stage enthalpy-enhanced and volume-variable compressor can be unloaded is as follows.

Figure 7:
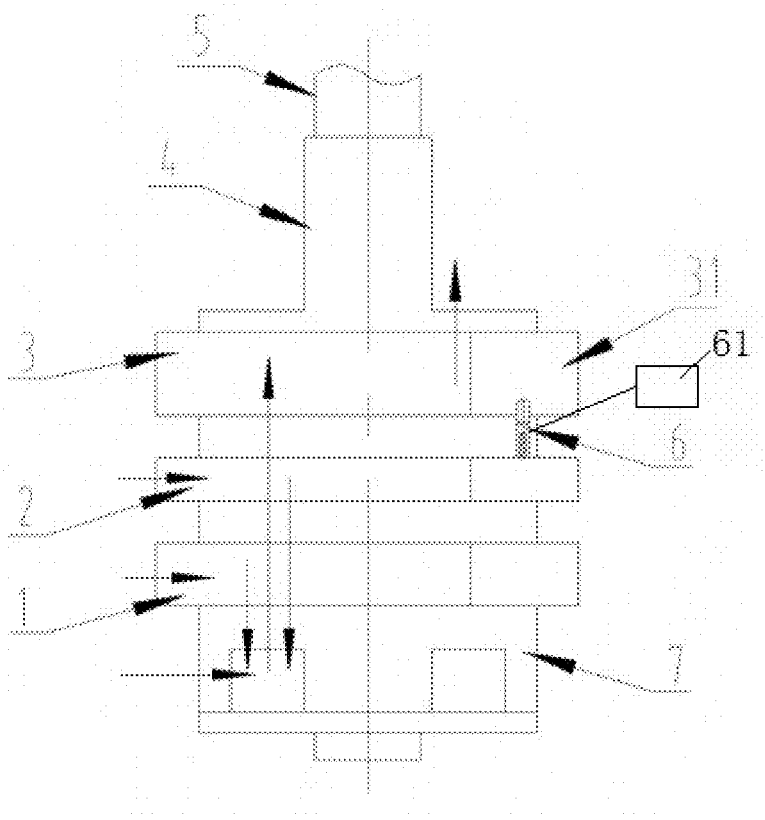
FIG. 7-9 are structural diagrams of a compressor having a secondary cylinder which can be unloaded according to the invention.

As an implementable mode, as shown in FIG. 1 or FIG. 7, the first primary cylinder 1 and the second primary cylinder 2 are provided at a lower side of the secondary cylinder 3 separately, the first separator or the second separator is provided with the slide piece control device 6, and the first primary cylinder 1 or the second primary cylinder 2 serves as an unloadable cylinder.

Figure 2:
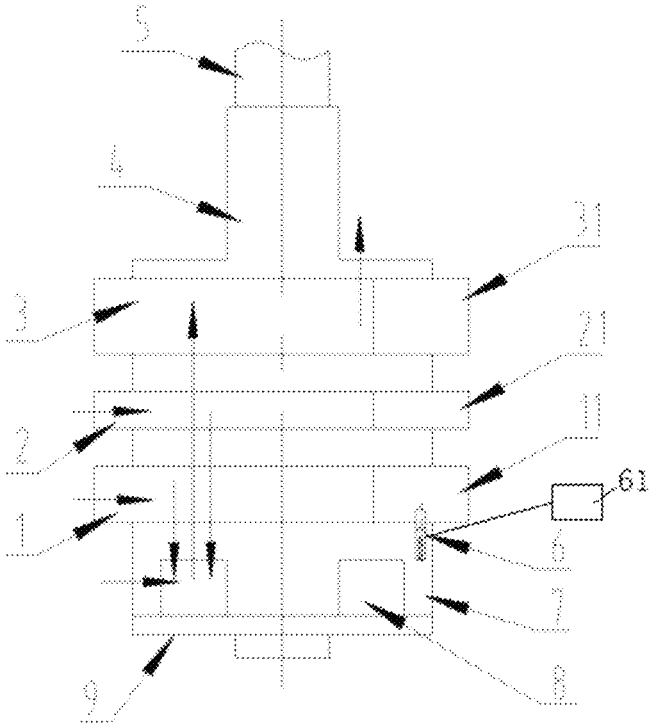

As an implementable mode, as shown in FIG. 2, the first primary cylinder 1 and the second primary cylinder 2 are provided at a lower side of the secondary cylinder 3 separately, the lower flange 7 is provided with the slide piece control device 6, and a lower one (first primary cylinder 1 in FIG. 2) of the first primary cylinder 1 and the second primary cylinder 2 serves as an unloadable cylinder.

Figure 3:
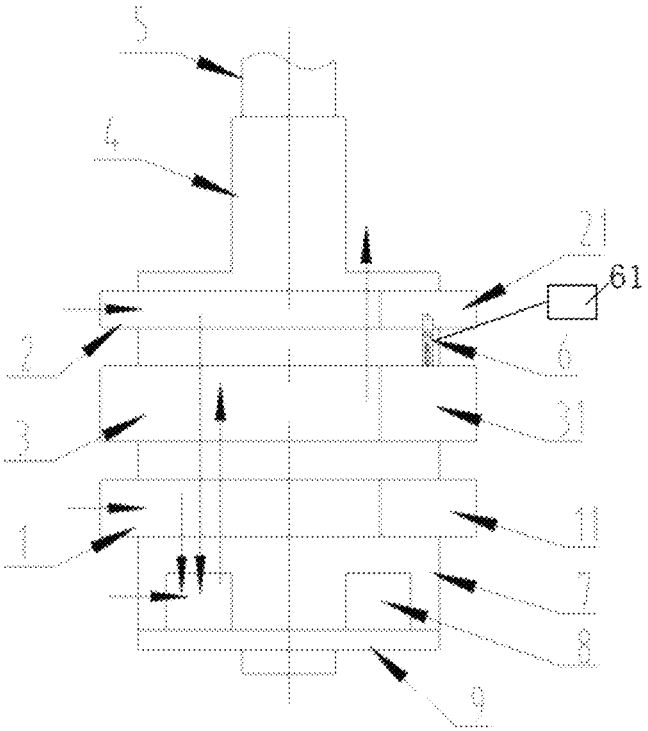
Figure 8:
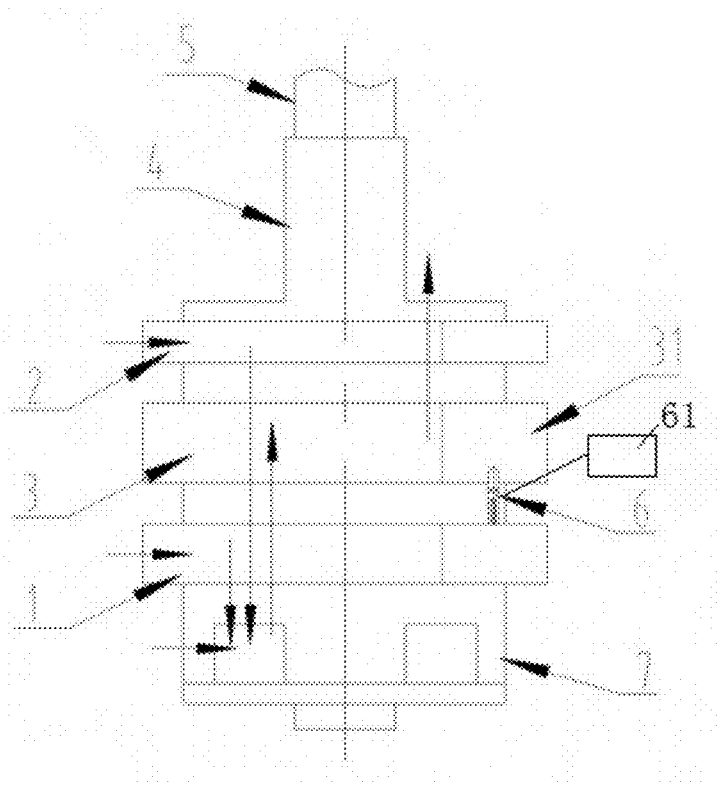

As an implementable mode, as shown in FIG. 3 and FIG. 8, the secondary cylinder 3 is provided between the first primary cylinder 1 and the second primary cylinder 2, an upper one of the first separator and the second separator is provided with the slide piece control device 6, and the second primary cylinder 2 serves as an unloadable cylinder.

Figure 4:
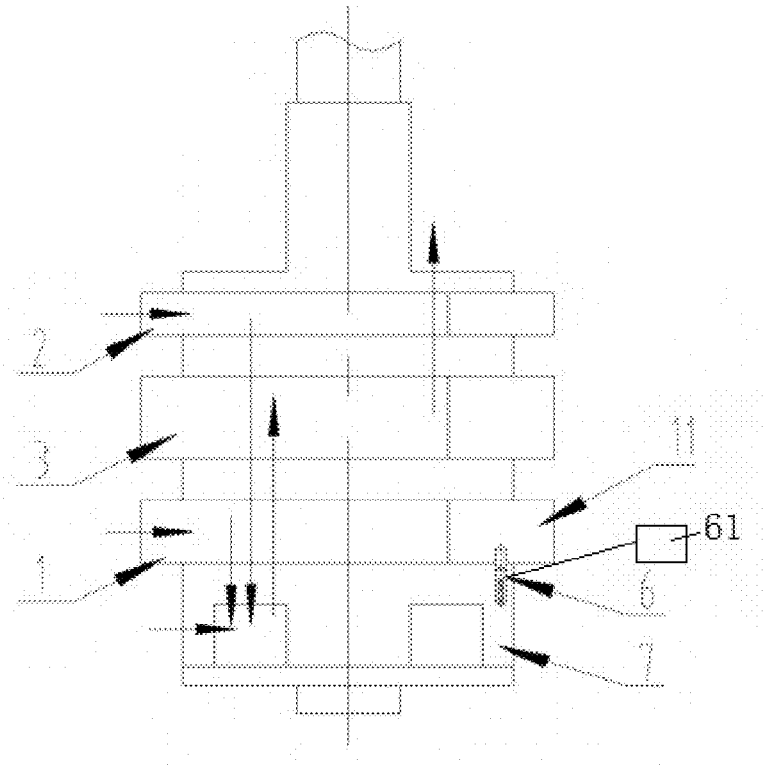

As an implementable mode, as shown in FIG. 4, the secondary cylinder 3 is provided between the first primary cylinder 1 and the second primary cylinder 2, the lower flange 7 is provided with the slide piece control device 6, and a lower one (first primary cylinder 1 in FIG. 4) of the first primary cylinder 1 and the second primary cylinder 2 serves as an unloadable cylinder.

Figure 5:
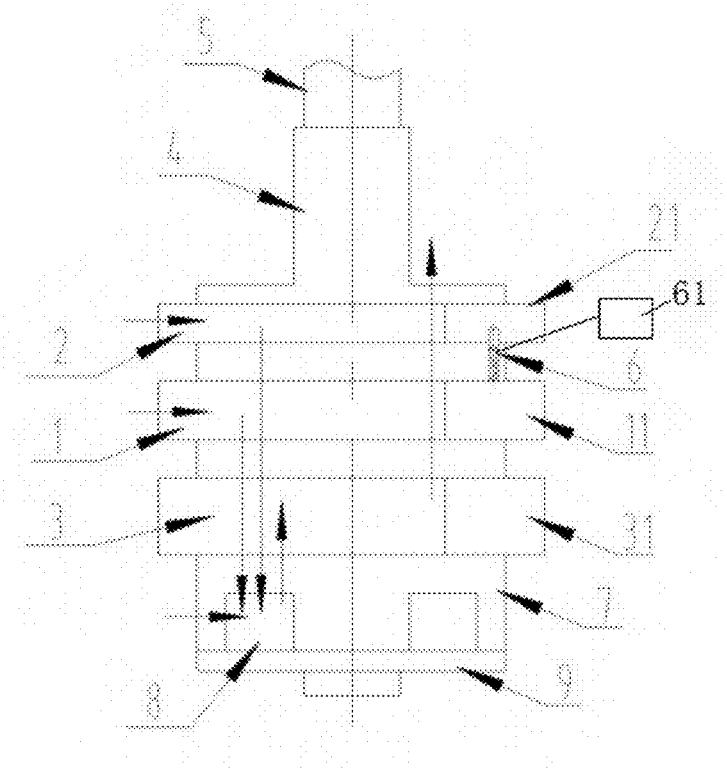
Figure 6:
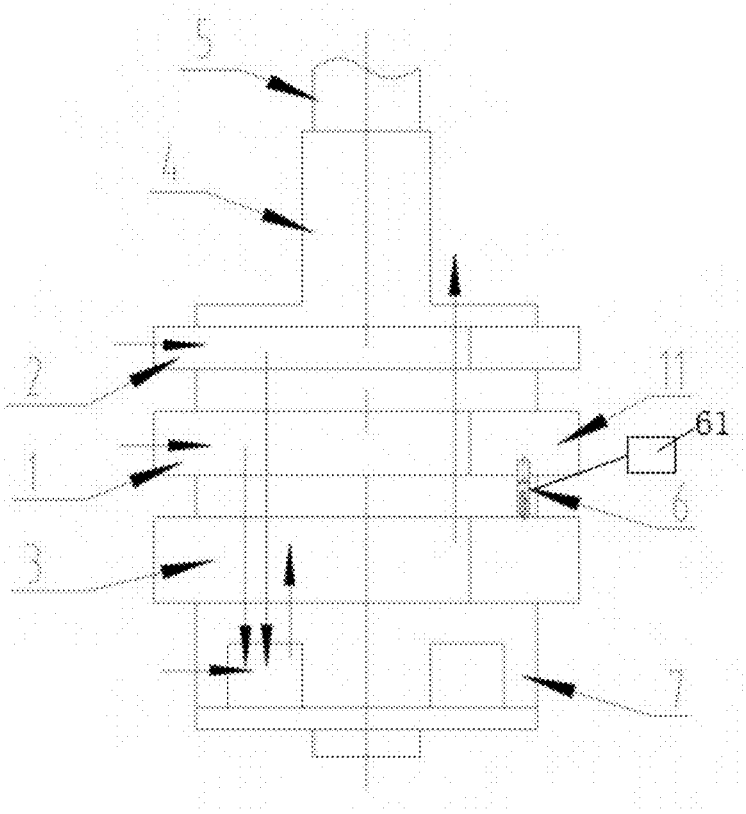

As an implementable mode, as shown in FIG. 5 and FIG. 6, the first primary cylinder 1 and the second primary cylinder 2 are provided at an upper side of the secondary cylinder 3 separately, the first separator or the second separator is provided with the slide piece control device 6, and the first primary cylinder 1 or the second primary cylinder 2 serves as an unloadable cylinder.

The situation where a low-pressure cylinder may be unloaded is illustrated with FIG. 1. The second primary cylinder 2 in FIG. 1 is an unloadable cylinder. When the second primary cylinder 2 normally works, the flow direction of a refrigerant is shown as the direction of an arrow in FIG. 1. The compressor sucks a refrigerant of which the pressure is Ps from a liquid separator through the first air entry and the second air entry, compresses the refrigerant and then discharges the refrigerant into the intermediate cavity 8. After the refrigerant discharged from the first primary cylinder 1 is mixed with a refrigerant sucked from a flash evaporator through an air supply enthalpy-enhanced opening in the intermediate cavity 8, the mixed refrigerant enters the secondary cylinder 3, is compressed by the secondary cylinder 3, is discharged from the air outlet, and then enters a closed cavity, thus realizing three-cylinder double-stage enthalpy-enhanced operation. In this case, a ratio of a secondary volume to a primary volume may reach 0.3-0.6.

When the second primary cylinder 2 is unloaded and does not work, the compressor sucks a refrigerant of which the pressure is Ps from the liquid separator through the first air entry, performs primary compression on the refrigerant by means of the first primary cylinder and then discharges the refrigerant into the intermediate cavity 8. After the discharged refrigerant is mixed with a refrigerant sucked from the flash evaporator through the air supply enthalpy-enhanced opening in the intermediate cavity 8, the mixed refrigerant enters the secondary cylinder 3, and is compressed by the secondary cylinder 3 to form a refrigerant of which the pressure is Pd, and the refrigerant is discharged from the air outlet and enters the closed cavity, thus realizing double-cylinder double-stage enthalpy-enhanced operation. In this case, a ratio of a secondary volume to a primary volume may reach 0.8-1.3.

Embodiment 2

A situation where a secondary cylinder of a three-cylinder double-stage enthalpy-enhanced and volume-variable compressor can be unloaded is as follows.

As an implementable mode, as shown in FIG. 7, the first primary cylinder 1 and the second primary cylinder 2 are provided at a lower side of the secondary cylinder 3 separately, the first separator or the second separator is provided with the slide piece control device 6, and the first primary cylinder 1 or/and the second primary cylinder 2 serve(s) as an unloadable cylinder(s).

As an implementable mode, as shown in FIG. 8, the secondary cylinder 3 is provided between the first primary cylinder 1 and the second primary cylinder 2, a lower one of the first separator and the second separator is provided with the slide piece control device 6, and the secondary cylinder 3 serves as an unloadable cylinder.

Figure 9:
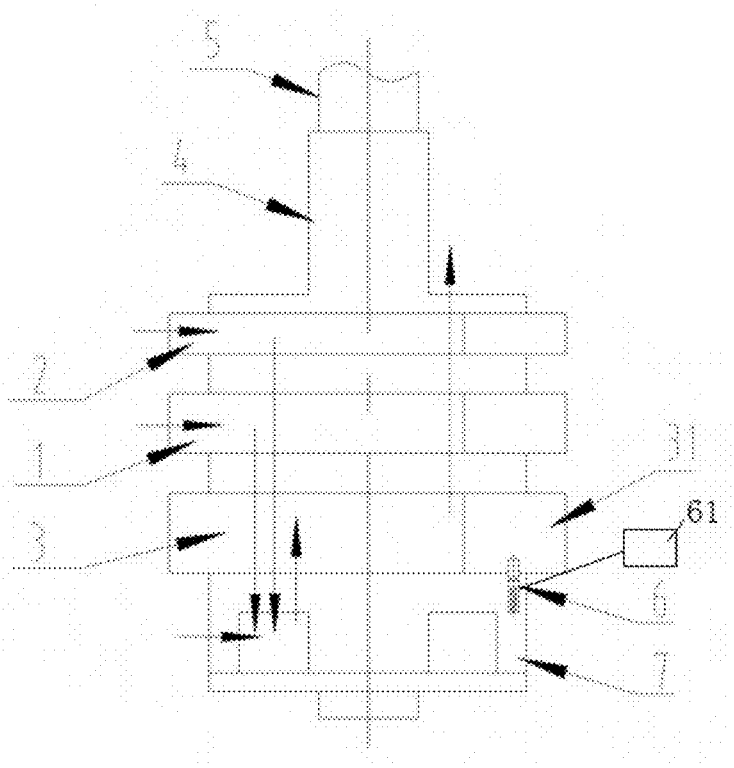

As an implementable mode, as shown in FIG. 9, the first primary cylinder 1 and the second primary cylinder 2 are provided at an upper side of the secondary cylinder 3 separately, the lower flange 7 is provided with the slide piece control device 6, and the secondary cylinder 3 serves as an unloadable cylinder.

The situation where the secondary cylinder 3 may be unloaded is illustrated with FIG. 7. The secondary cylinder 3 in FIG. 7 is an unloadable cylinder. When the secondary cylinder 3 normally works, the flow direction of a refrigerant is shown as the direction of an arrow in FIG. 7. The compressor sucks a refrigerant of which the pressure is Ps from the liquid separator through the first air entry and the second air entry, performs primary compression on the refrigerant by means of the first primary cylinder 1 and the second primary cylinder 2, and then discharges the refrigerant into the intermediate cavity 8. After the refrigerant discharged from the first primary cylinder 1 and the second primary cylinder 2 is mixed with a refrigerant sucked from the flash evaporator through the air supply enthalpy-enhanced opening in the intermediate cavity 8, the mixed refrigerant enters the secondary cylinder 3, is compressed by the secondary cylinder 3, is discharged from the air outlet, and then enters the closed cavity, thus realizing three-cylinder double-stage enthalpy-enhanced operation. In this case, a ratio of a secondary volume to a primary volume may reach 0.8-1.3.

When the secondary cylinder 3 is unloaded and does not work, the compressor sucks a refrigerant of which the pressure is Ps from the liquid separator through the first air entry and the second air entry, and compresses the refrigerant by means of the first primary cylinder 1 and the second primary cylinder 2 to form a Pd refrigerant. The refrigerant is discharged into the intermediate cavity 8, the secondary cylinder 3 performs secondary compression, and the refrigerant is discharged from the air outlet and enters the closed cavity, thus realizing double-cylinder operation.

Embodiment 3

A situation where a first primary cylinder 1 and second primary cylinder 2 of a three-cylinder double-stage enthalpy-enhanced and volume-variable compressor can be unloaded simultaneously is as follows.

Figure 10:
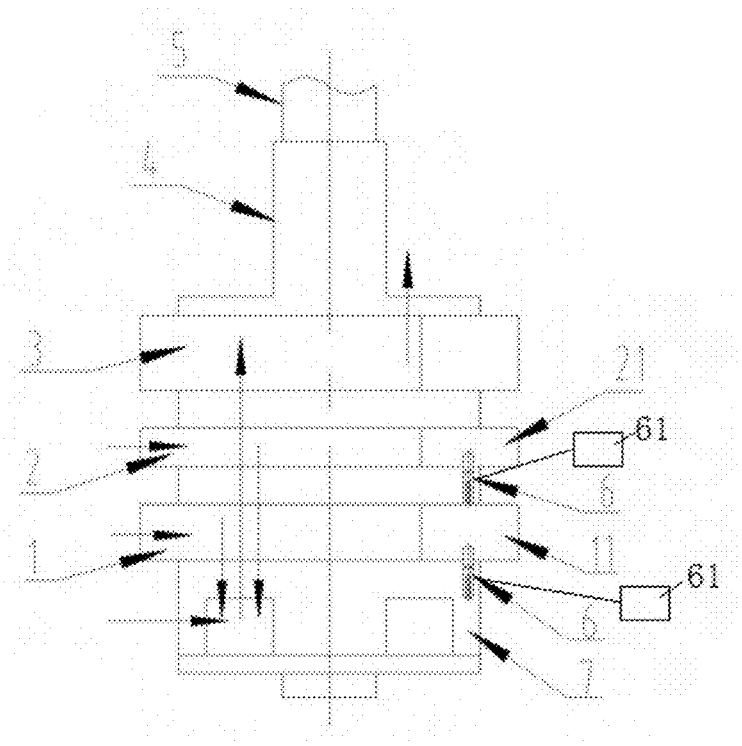
FIG. 10-12 are structural diagrams of a compressor having two primary cylinders which can be unloaded according to the invention.

As an implementable mode, as shown in FIG. 10, the first primary cylinder 1 and the second primary cylinder 2 are provided at a lower side of the secondary cylinder 3 separately, the lower flange 7 is provided with the slide piece control device 6, and a lower one (first primary cylinder 1 in FIG. 10) of the first primary cylinder 1 and the second primary cylinder 2 serves as an unloadable cylinder; and the first separator (a separator between the first primary cylinder 1 and the second primary cylinder 2 in FIG. 10) is also provided with the slide piece control device 6, and an upper one (second primary cylinder 2 in FIG. 10) of the first primary cylinder 1 and the second primary cylinder 2 serves as an unloadable cylinder.

Figure 11:
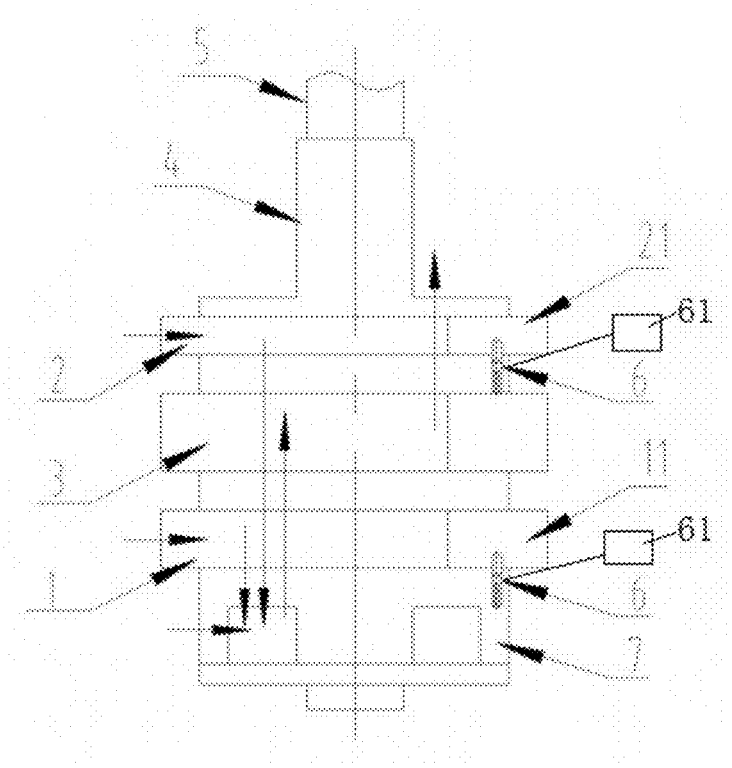

As an implementable mode, as shown in FIG. 11, the secondary cylinder 3 is provided between the first primary cylinder 1 and the second primary cylinder 2, the lower flange 7 is provided with the slide piece control device 6, and a lower one of the first primary cylinder 1 and the second primary cylinder 2 serves as an unloadable cylinder; and the second separator (a separator between the second primary cylinder 2 and the secondary cylinder 3 in FIG. 11) is also provided with the slide piece control device 6, and an upper one (second primary cylinder 2 in FIG. 11) of the first primary cylinder 1 and the second primary cylinder 2 also serves as an unloadable cylinder.

Figure 12:
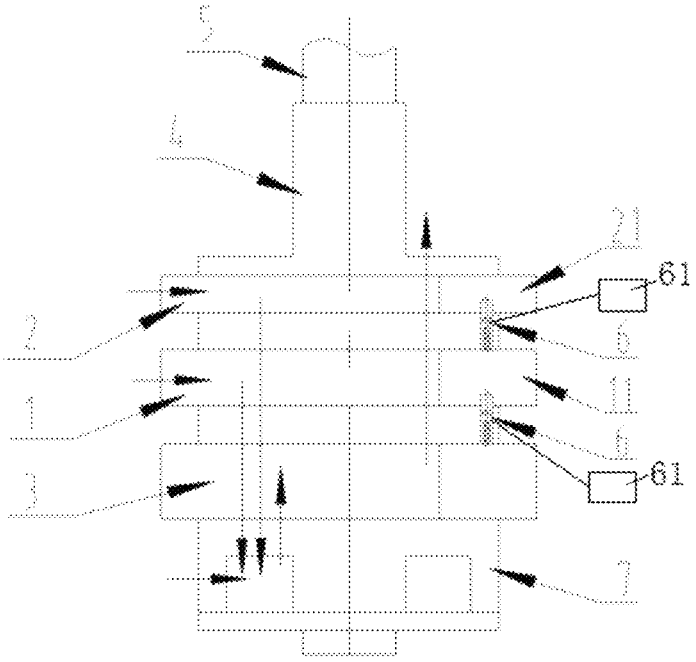

As an implementable mode, as shown in FIG. 12, the first primary cylinder 1 and the second primary cylinder 2 are provided at an upper side of the secondary cylinder 3 separately, the first separator and the second separator are provided with the slide piece control devices 6, and the first primary cylinder 1 and the second primary cylinder 2 serve as unloadable cylinders.

The situation where two low-pressure cylinders may be unloaded simultaneously is illustrated with FIG. 10. The first primary cylinder 1 and the second primary cylinder 2 in FIG. 10 are unloadable cylinders. When the first primary cylinder 1 and the second primary cylinder 2 normally work, the flow direction of a refrigerant is shown as the direction of an arrow in FIG. 10. The compressor sucks a refrigerant of which the pressure is Ps from the liquid separator through the first air entry 11 and the second air entry, compresses the refrigerant by means of the first primary cylinder 1 and the second primary cylinder 2 and then discharges the refrigerant into the intermediate cavity 8. After the refrigerant discharged from the first primary cylinder 1 and the second primary cylinder 2 is mixed with a refrigerant sucked from the flash evaporator through the air supply enthalpy-enhanced opening in the intermediate cavity 8, the mixed refrigerant enters the secondary cylinder 3, is compressed by the secondary cylinder 3, is discharged from the air outlet, and then enters the closed cavity, thus realizing three-cylinder double-stage enthalpy-enhanced operation. In this case, a ratio of a secondary volume to a primary volume may reach 0.3-0.6.

When the second primary cylinder 2 is unloaded and does not work and the first primary cylinder 1 normally works, the compressor sucks a refrigerant of which the pressure is Ps from the liquid separator through the first air entry, and compresses the refrigerant by means of the first primary cylinder 1 to form a Pd refrigerant. The refrigerant is discharged into the intermediate cavity 8. After the refrigerant discharged from the first primary cylinder 1 is mixed with a refrigerant sucked from the flash evaporator through the air supply enthalpy-enhanced opening in the intermediate cavity 8, the mixed refrigerant enters the secondary cylinder 3, and is compressed by the secondary cylinder 3 to form the Pd refrigerant, and the refrigerant is discharged from the air outlet and enters the closed cavity, thus realizing double-cylinder double-stage enthalpy-enhanced operation. In this case, a ratio of a secondary volume to a primary volume may reach 0.8-1.3.

When the first primary cylinder 1 is unloaded and does not work and the second primary cylinder 2 normally works, the compressor sucks a refrigerant of which the pressure is Ps from the liquid separator through the second air entry, and compresses the refrigerant by means of the second primary cylinder 2 to form a Pd refrigerant. The refrigerant is discharged into the intermediate cavity 8. After the refrigerant discharged from the second primary cylinder 2 is mixed with a refrigerant sucked from the flash evaporator through the air supply enthalpy-enhanced opening in the intermediate cavity 8, the mixed refrigerant enters the secondary cylinder 3, and is compressed by the secondary cylinder 3 to form the Pd refrigerant, and the refrigerant is discharged from the air outlet and enters the closed cavity, thus realizing double-cylinder double-stage enthalpy-enhanced operation. In this case, a ratio of a secondary volume to a primary volume may reach 0.8-1.3.

When both the first primary cylinder 1 and the second primary cylinder 2 are unloaded and do not work, the compressor sucks a refrigerant of which the pressure is Ps from the liquid separator through the first air entry and the second air entry, the refrigerant passes through the first primary cylinder 1, the second primary cylinder 2 and the intermediate cavity 8, enters the secondary cylinder 3, and is compressed by the secondary cylinder 3 to form a Pd refrigerant, and the refrigerant is discharged from the air outlet and enters the closed cavity, thus realizing single-cylinder operation.

Embodiment 4

A situation where a primary cylinder and secondary cylinder of a three-cylinder double-stage enthalpy-enhanced and volume-variable compressor can be unloaded simultaneously is as follows.

Figure 13:
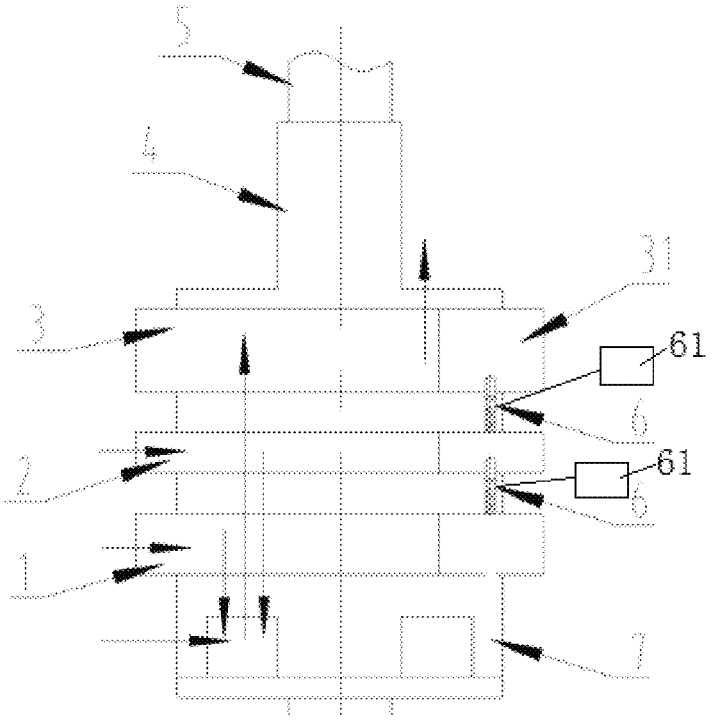
FIG. 13-18 are structural diagrams of a compressor having a primary cylinder and a secondary cylinder which can be unloaded simultaneously according to the invention.

As an implementable mode, as shown in FIG. 13, the first primary cylinder 1 and the second primary cylinder 2 are provided at a lower side of the secondary cylinder 3 separately, the first separator and the second separator are provided with the slide piece control devices 6, and the first primary cylinder 1 or/and the second primary cylinder 2 serve(s) as an unloadable cylinder(s).

Figure 14:
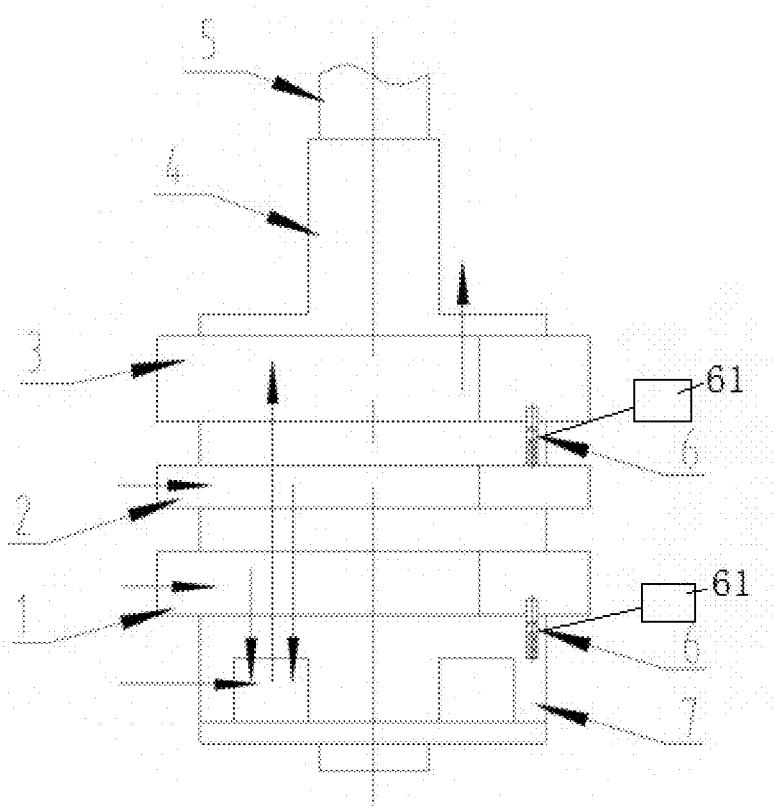

As an implementable mode, as shown in FIG. 14, the first primary cylinder 1 and the second primary cylinder 2 are provided at the lower side of the secondary cylinder 3 separately, the lower flange 7 is provided with the slide piece control device 6, and a lower one (first primary cylinder 1 in FIG. 14) of the first primary cylinder 1 and the second primary cylinder 2 serves as an unloadable cylinder; and the second separator (a separator between the secondary cylinder 3 and the second primary cylinder 2 in FIG. 14) is also provided with the slide piece control device 6, and the secondary cylinder 3 also serves as an unloadable cylinder.

Figure 15:
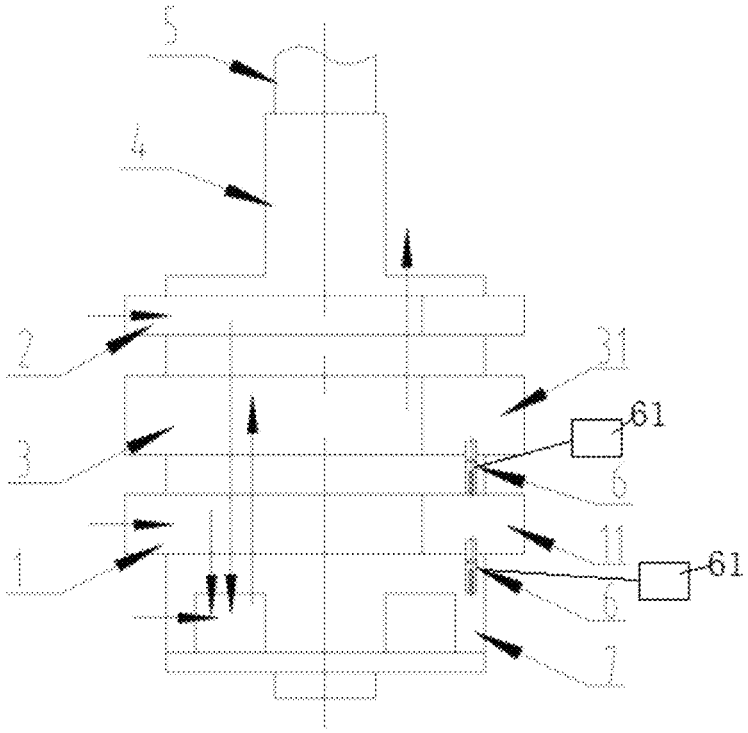

As an implementable mode, as shown in FIG. 15, the secondary cylinder 3 is provided between the first primary cylinder 1 and the second primary cylinder 2, the lower flange 7 is provided with the slide piece control device 6, and a lower one of the first primary cylinder 1 and the second primary cylinder 2 serves as an unloadable cylinder; and the second separator (a separator between the first primary cylinder 1 and the secondary cylinder 3 in FIG. 11) is also provided with the slide piece control device 6, and the secondary cylinder 3 also serves as an unloadable cylinder.

Figure 16:
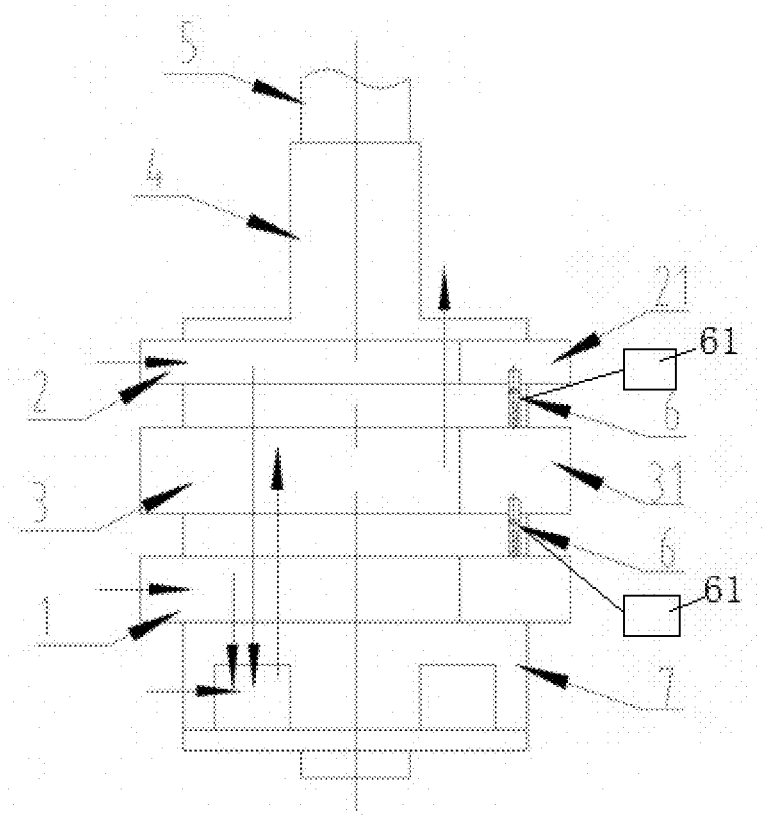

As an implementable mode, as shown in FIG. 16, the secondary cylinder 3 is provided between the first primary cylinder 1 and the second primary cylinder 2, the first separator and the second separator are provided with the slide piece control devices 6 respectively, and both the first primary cylinder 1 and the second primary cylinder 2 serve as unloadable cylinders.

Figure 17:
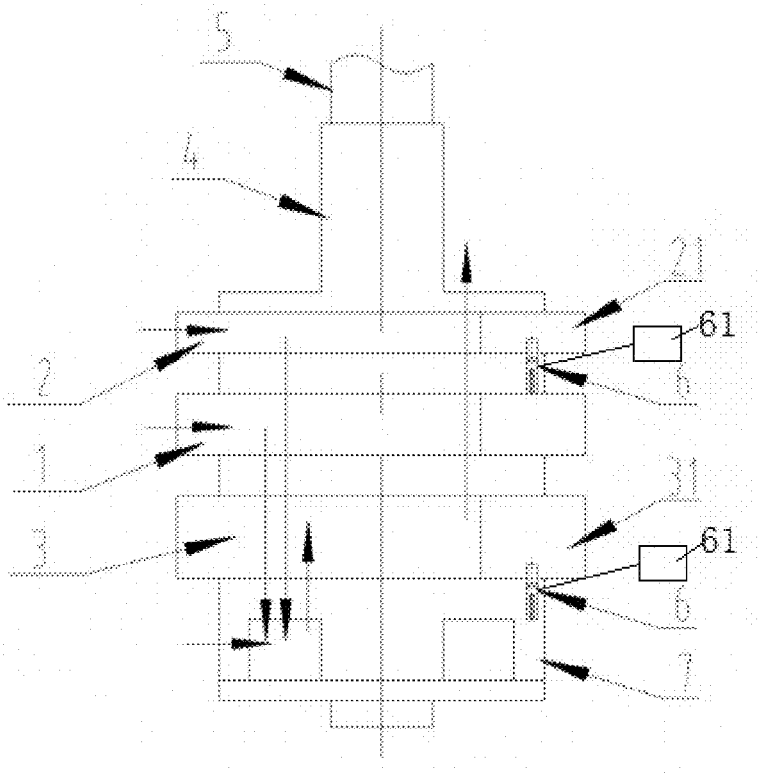
Figure 18:
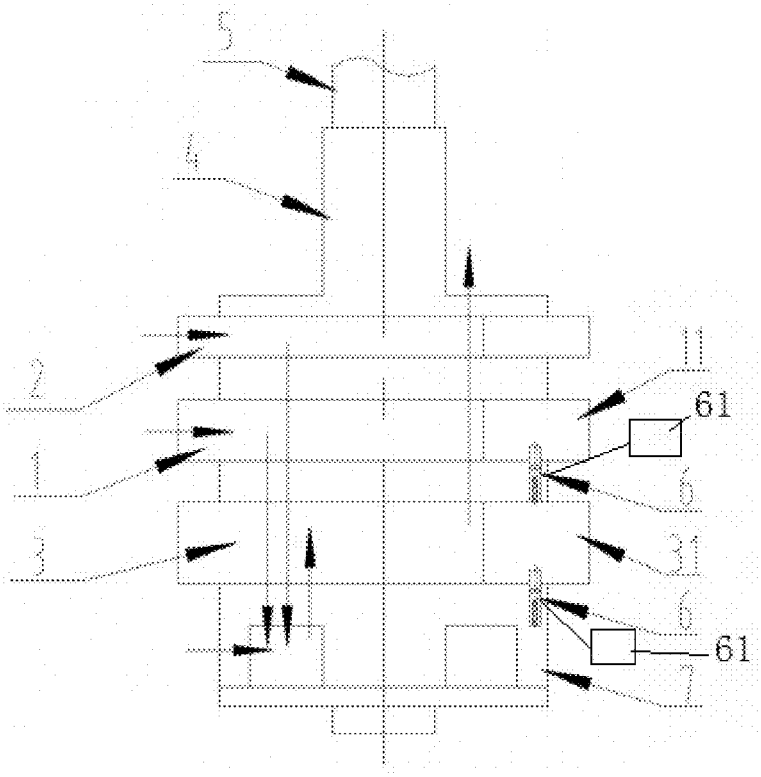

As an implementable mode, as shown in FIG. 17 and FIG. 18, the first primary cylinder 1 and the second primary cylinder 2 are provided at an upper side of the secondary cylinder 3 respectively, the lower flange 7 is provided with the slide piece control device 6, and the secondary cylinder 3 serves as an unloadable cylinder; and the first separator or the second separator is also provided with the slide piece control device 6, and the first primary cylinder 1 or the second primary cylinder 2 also serves as an unloadable cylinder.

The situation where one primary cylinder and one second cylinder may be unloaded simultaneously is illustrated with FIG. 13. The second primary cylinder 2 and the secondary cylinder 3 in FIG. 10 are unloadable cylinders. When the second primary cylinder 2 and the secondary cylinder 3 normally work, the flow direction of a refrigerant is shown as the direction of an arrow in FIG. 10. The compressor sucks a refrigerant of which the pressure is Ps from the liquid separator through the first air entry and the second air entry, compresses the refrigerant by means of the first primary cylinder 1 and the second primary cylinder 2 and then discharges the refrigerant into the intermediate cavity 8. After the refrigerant discharged from the first primary cylinder 1 and the second primary cylinder 2 is mixed with a refrigerant sucked from the flash evaporator through the air supply enthalpy-enhanced opening in the intermediate cavity 8, the mixed refrigerant enters the secondary cylinder 3, is compressed by the secondary cylinder 3, is discharged from the air outlet, and then enters the closed cavity, thus realizing three-cylinder double-stage enthalpy-enhanced operation. In this case, a ratio of a secondary volume to a primary volume may reach 0.3-0.6.

When the second primary cylinder 2 is unloaded and does not work and the secondary cylinder 3 normally works, the compressor sucks a refrigerant of which the pressure is Ps from the liquid separator through the first air entry 11, and compresses the refrigerant by means of the first primary cylinder 1 to form a Pd refrigerant. The refrigerant is discharged into the intermediate cavity 8. After the refrigerant discharged from the first primary cylinder 1 is mixed with a refrigerant sucked from the flash evaporator through the air supply enthalpy-enhanced opening in the intermediate cavity 8, the mixed refrigerant enters the secondary cylinder 3, and is compressed by the secondary cylinder 3 to form the Pd refrigerant, and the refrigerant is discharged from the air outlet and enters the closed cavity, thus realizing double-cylinder double-stage enthalpy-enhanced operation. In this case, a ratio of a secondary volume to a primary volume may reach 0.8-1.3.

When the secondary cylinder 3 is unloaded and does not work and the second primary cylinder 2 normally works, the compressor sucks a refrigerant of which the pressure is Ps from the liquid separator through the first air entry and the second air entry, and compresses the refrigerant by means of the first primary cylinder 1 and the second primary cylinder 2, and then discharges the refrigerant into the intermediate cavity 8. The refrigerant passes through the secondary cylinder 3, is discharged from the air outlet and then enters the closed cavity, thus realizing double-cylinder operation.

When both the second primary cylinder 2 and the secondary cylinder 3 are unloaded and do not work, the compressor sucks a refrigerant of which the pressure is Ps from the liquid separator through the first air entry, the refrigerant is compressed by means of the first primary cylinder and discharged into the intermediate cavity 8, and the refrigerant passes through the secondary cylinder 3, is discharged from the air outlet and enters the closed cavity, thus realizing single-cylinder operation.

The invention also relates to an air conditioner, which comprises the compressor in any one of the technical solutions. Except the compressor, other components of the air conditioner are components in the conventional art, which will not be elaborated herein one by one.

In the compressor and air conditioner of the above embodiments, the compressor may operate in multiple modes, and different modes may be selected according to different application occasions, thus improving the heating capability, and improving the capabilities of a rated point and an intermediate point. The structural limitation is avoided, and the displacement is increased, thus reducing the size of the compressor, and lowering the cost. Two primary cylinders may not be limited by series, so as to achieve large-displacement compression. The volumes may be variable by changing working and unloading states of the cylinders, and requirements for energy efficiency and capabilities under different compressor working conditions are met. For example, the heating capacity under a low-temperature heating situation may be greatly increased by means of three-cylinder double-stage enthalpy-enhanced operation, the energy efficiency of the intermediate point may be improved by means of single-cylinder operation, and the energy efficiency of the rated point may be improved and guaranteed by means of double-cylinder double-stage enthalpy-enhanced operation or double-cylinder operation.

The above embodiments only express several implementations of the invention, and descriptions thereof are relatively specific and detailed, but cannot be accordingly understood as limitation to the scope of the invention. It should be pointed out that those skilled in the art can also make some transformations and improvements without departing from the concept of the invention. These transformations and improvements should fall within the protective scope of the invention. Therefore, the protective scope of the invention should refer to the appended claims.

The invention claimed is:

1. A compressor, comprising:

a first primary cylinder, a second primary cylinder, a third cylinder and a lower flange, wherein the first primary cylinder, the second primary cylinder and the third cylinder are stacked, two separators are provided where a respective separator is provided between two adjacent cylinders, the third cylinder is provided at the same side of the first primary cylinder and the second primary cylinder, or the third cylinder is provided between the first primary cylinder and the second primary cylinder, and the lower flange is provided at the lower sides of the first primary cylinder, the second primary cylinder and the third cylinder;

the first primary cylinder is provided with a first air entry and a first slide piece groove, a first slide piece is provided in the first slide piece groove, the second primary cylinder is provided with a second air entry and a second slide piece groove, a second slide piece is provided in the second slide piece groove, the third cylinder is provided with an air outlet and a third slide piece groove, and a third slide piece is provided in the third slide piece groove; the first primary cylinder and the second primary cylinder are connected in parallel, the first primary cylinder and the second primary cylinder are connected in serial to the third cylinder after being connected in parallel, and a refrigerant entering the first air entry and the second air entry is discharged from the air outlet after primary or/and secondary compression;

the two separators are divided into a first separator and a second separator, and any one or two of the first separator, the second separator and the lower flange are provided with a slide piece control device configured to control a slide piece to act, the slide piece control device locks or unlocks any one of the first slide piece, the second slide piece and the third slide piece; wherein during the operation of the compressor, one or two of the first primary cylinder, the second primary cylinder and the third cylinder has a working state and an unloaded state; and the compressor can operate in multiple modes, the multiple modes comprise a three-cylinder double-stage enthalpy-enhanced operation, a double-cylinder double-stage enthalpy-enhanced operation, a double-cylinder operation, wherein depending on the different application occasions the compressor is selected to operate in an appropriate one of the multiple modes;

wherein during operation of the compressor one or two of the first primary cylinder, the second primary cylinder, and the third cylinder has the unloaded state when the respective one or two of the first slide piece, the second slide piece, and the third slide piece is in a locked state and therefore no compression occurs in the respective cylinder; and during operation of the compressor the respective one or two of the first primary cylinder, the second primary cylinder, and the third cylinder has the working state when the respective one or two of the first slide piece, the second slide piece, and the third slide piece is in a unlocked state allowing the respective cylinder to compress refrigerant.

2. The compressor according to claim 1, wherein the first primary cylinder and the second primary cylinder are provided at a lower side of the third cylinder separately, the first separator or/and the second separator is/are provided with the slide piece control device, and the first primary cylinder or/and the second primary cylinder serve(s) as an unloadable cylinder(s).

3. The compressor according to claim 2, wherein the slide piece control device comprises a pin and an elastic reset element, the elastic reset element is provided at a tail of the pin, any one or two of the first slide piece, the second slide piece and the third slide piece are provided with a locking groove, the pin is configured to match with the locking groove, when the pin is provided in the locking groove, the slide piece is locked, and after the pin is disengaged from the locking groove, the slide piece is unlocked.

4. The compressor according to claim 2, wherein the lower flange is provided with an intermediate cavity.

5. The compressor according to claim 1, wherein the first primary cylinder and the second primary cylinder are provided at a lower side of the third cylinder separately, the lower flange is provided with the slide piece control device, and a lower one of the first primary cylinder and the second primary cylinder serves as an unloadable cylinder.

6. The compressor according to claim 5, wherein the first separator or the second separator is provided with the slide piece control device, an upper one of the first primary cylinder and the second primary cylinder serves as an unloadable cylinder, or the third cylinder serves as an unloadable cylinder.

7. The compressor according to claim 1, wherein the third cylinder is provided between the first primary cylinder and the second primary cylinder, the first separator or/and the second separator are provided with the slide piece control device, the first primary cylinder or/and the third cylinder serve(s) as an unloadable cylinder(s), or the second primary cylinder or/and the third cylinder serve(s) as an unloadable cylinder(s).

8. The compressor according to claim 1, wherein the third cylinder is provided between the first primary cylinder and the second primary cylinder, the lower flange is provided with the slide piece control device, and a lower one of the first primary cylinder and the second primary cylinder serves as an unloadable cylinder.

9. The compressor according to claim 8, wherein the first separator or the second separator is provided with the slide piece control device, an upper one of the first primary cylinder and the second primary cylinder serves as an unloadable cylinder, or the third cylinder serves as an unloadable cylinder.

10. The compressor according to claim 9, wherein the first primary cylinder and the second primary cylinder are provided at an upper side of the third cylinder separately, the first separator or/and the second separator are provided with the slide piece control device, and the first primary cylinder or/and the second primary cylinder serve(s) as an unloadable cylinder(s).

11. The compressor according to claim 9, wherein the first primary cylinder and the second primary cylinder are provided at an upper side of the third cylinder separately, the lower flange is provided with the slide piece control device, and the third cylinder serves as an unloadable cylinder.

12. The compressor according to claim 11, wherein the first separator or the second separator is provided with the slide piece control device, and the first primary cylinder or the second primary cylinder serves as an unloadable cylinder.

13. The compressor according to claim 9, wherein the slide piece control device comprises a pin and an elastic reset element, the elastic reset element is provided at a tail of the pin, any one or two of the first slide piece, the second slide piece and the third slide piece are provided with a locking groove, the pin is configured to match with the locking groove, when the pin is provided in the locking groove, any one or two of the first slide piece, the second slide piece and the third slide piece is locked, and after the pin is disengaged from the locking groove, any one or two of the first slide piece, the second slide piece and the third slide piece is unlocked.

14. The compressor according to claim 13, wherein the first separator or/and the second separator are provided with a through hole corresponding to the locking groove; or, the first separator or/and the lower flange is/are provided with a through hole corresponding to the locking groove; or, the second separator or/and the lower flange is/are provided with a through hole corresponding to the locking groove; and the pin is provided in the through hole, the pin is in seal fit with the through hole, and the pin can move in an axial direction of the through hole.

15. The compressor according to claim 9, wherein a ratio of a second-stage volume to a first-stage volume of the compressor under a double-stage compression mode is 0.3-0.6 or 0.8-1.3, the first-stage volume is calculated from active cylinders comprising of the first primary cylinder and/or the second primary cylinder, the second-stage volume is from the third cylinder.

16. The compressor according to claim 9, wherein the lower flange is provided with an intermediate cavity.

* * * * *